United States Patent [19]

Brouwer et al.

[11] Patent Number: 5,061,100

[45] Date of Patent: Oct. 29, 1991

[54] PRINTER MECHANISM WITH VERTICALLY DISPLACEABLE PRINTING MEANS FOR USE WITH HORIZONTAL SHEET FEED MECHANISM

[75] Inventors: Frederick W. Brouwer; Graham Luckhurst, both of Kitchener; Fredrik L. N. Kallin, Waterloo, all of Canada

[73] Assignee: NCR Corporation, Dayton, Ohio

[21] Appl. No.: 635,898

[22] Filed: Dec. 28, 1990

[51] Int. Cl.[5] ..... B41J 13/12

[52] U.S. Cl. ..... 400/642; 101/93.11; 400/154.2; 400/154.5; 400/691; 400/692; 400/693

[58] Field of Search ..... 101/93.11; 400/642, 400/612, 154.2, 154.5, 82, 691, 692, 693, 634, 636

[56] References Cited

U.S. PATENT DOCUMENTS

| | | | |
|---|---|---|---|
| 4,431,322 | 2/1984 | Nally | 400/605 |
| 4,475,833 | 10/1984 | Sawicki | 400/605 |
| 4,542,998 | 9/1985 | Osmera | 400/139 |
| 4,591,281 | 5/1986 | Howard et al. | 400/126 |
| 4,624,588 | 11/1986 | Bivin | 400/105 |
| 4,692,041 | 9/1987 | Dyma | 400/82 |
| 4,828,416 | 5/1989 | Pensavecchia et al. | 400/624 |
| 4,944,620 | 7/1990 | Scozzafava | 400/608.1 |

FOREIGN PATENT DOCUMENTS

| | | | |
|---|---|---|---|
| 3048930 | 7/1982 | Fed. Rep. of Germany | 101/93.11 |
| 2033304 | 5/1980 | United Kingdom | 101/93.11 |
| 2180681 | 4/1987 | United Kingdom | 400/642 |

*Primary Examiner*—Edgar S. Burr
*Assistant Examiner*—Eric P. Raciti
*Attorney, Agent, or Firm*—Stephen F. Jewett; Albert L. Sessler, Jr.; Elmer Wargo

[57] ABSTRACT

Front and rear printers for use with a document transport mechanism. The printers are identical in construction with each having a compact housing in which the associated print head is mounted. The housing has first and second side walls, a front wall which also functions as a guide for guiding documents to be printed upon therepast, and a rear wall which functions as a circuit board which houses the driver electronics assocated with the printer. The print head (ink jet) is mounted on a carriage which is moved within the housing in a first direction which is perpendicular to the direction in which the documents are moved in a document track past the printers. The front and rear printers are detachably mounted on opposed sides of the document track to enable the printing of alphanumerics or graphics on the front or the rear of a document moving thereby.

14 Claims, 6 Drawing Sheets

PRINTER MECHANISM WITH VERTICALLY DISPLACEABLE PRINTING MEANS FOR USE WITH HORIZONTAL SHEET FEED MECHANISM

CROSS REFERENCE TO RELATED APPLICATION

This application is related to U.S. patent application Ser. No. 07/634,672 entitled, TABLE TOP IMAGE BASED DOCUMENT PROCESSING MACHINE AND METHODS OF PROCESSING DOCUMENTS by Fredrik Kallin et al., said application being filed on Dec. 27, 1990 and being assigned to the same assignee as the present invention.

BACKGROUND OF THE INVENTION (1) Field of the Invention:

This invention relates to a printer mechanism which is especially useful for printing on documents which are moved in a document track past a printing station therein.

(2) Background Information:

Some of the problems associated with prior art printers is that they are generally, noisy, bulky, and require maintenance, especially when an ink jet print head is used in the printer mechanism. Another problem is that the usual endorsing of documents, like bank checks, generally utilizes a single "Logo" or endorsement stamp which is usually printed or endorsed on the back of the bank check as the documents are moved past an endorsing station positioned along a document track in which the documents are moved past the endorsing station.

SUMMARY OF THE INVENTION

The present invention obviates the problems mentioned in the Background in that it is compact, quiet, and requires little maintenance.

The present invention is especially useful in a sheet feeding environment like that employed by a teller at a bank, for example, although it may be used in other environments, like in the handling of library cards, airline boarding passes, and the like.

In a preferred embodiment of the invention, there is provided an apparatus comprising:

a base having a document track therein, with said document track having a bottom surface therein for guiding a document thereon;

a housing having first, second, third, and fourth walls forming a general quadrilateral tubular shape, and a spacer wall for maintaining said first and second walls in spaced parallel relationship;

support means coupled between said spacer wall and said base for supporting a carriage;

a carriage slidably mounted on said support means;

moving means for moving said carriage bi-directionally on said support means along a first line;

said third side wall being a flexible guide having an elongated slot therein;

securing means for securing said flexible guide to said first and second walls;

a print head;

mounting means for mounting said print head on said carriage to print through said elongated slot along the height of a document in said document track and transport means for bi-directionally moving said document along a second line perpendicular to said first line past said flexible guide in printing relationship with said print head.

In another aspect of the invention, there is provided a compact housing for a printer comprising:

first, second, third, and fourth walls forming a general quadrilateral tubular shape, and a spacer wall for maintaining said first and second walls in spaced parallel relationship;

mounting means for mounting a print head in said housing;

securing means for detachably securing said housing adjacent to a document track;

said third wall being in the shape of a document guide for guiding a document in said document track in operative relationship with said print head; and said fourth wall being in the shape of a circuit board having contacts thereon for engagement with a control means when said housing is secured adjacent to said document track.

The above advantages and others will be more readily understood in connection with the following description, claims, and drawing.

DESCRIPTION OF THE PREFERRED EMBODIMENT

Figure 1:
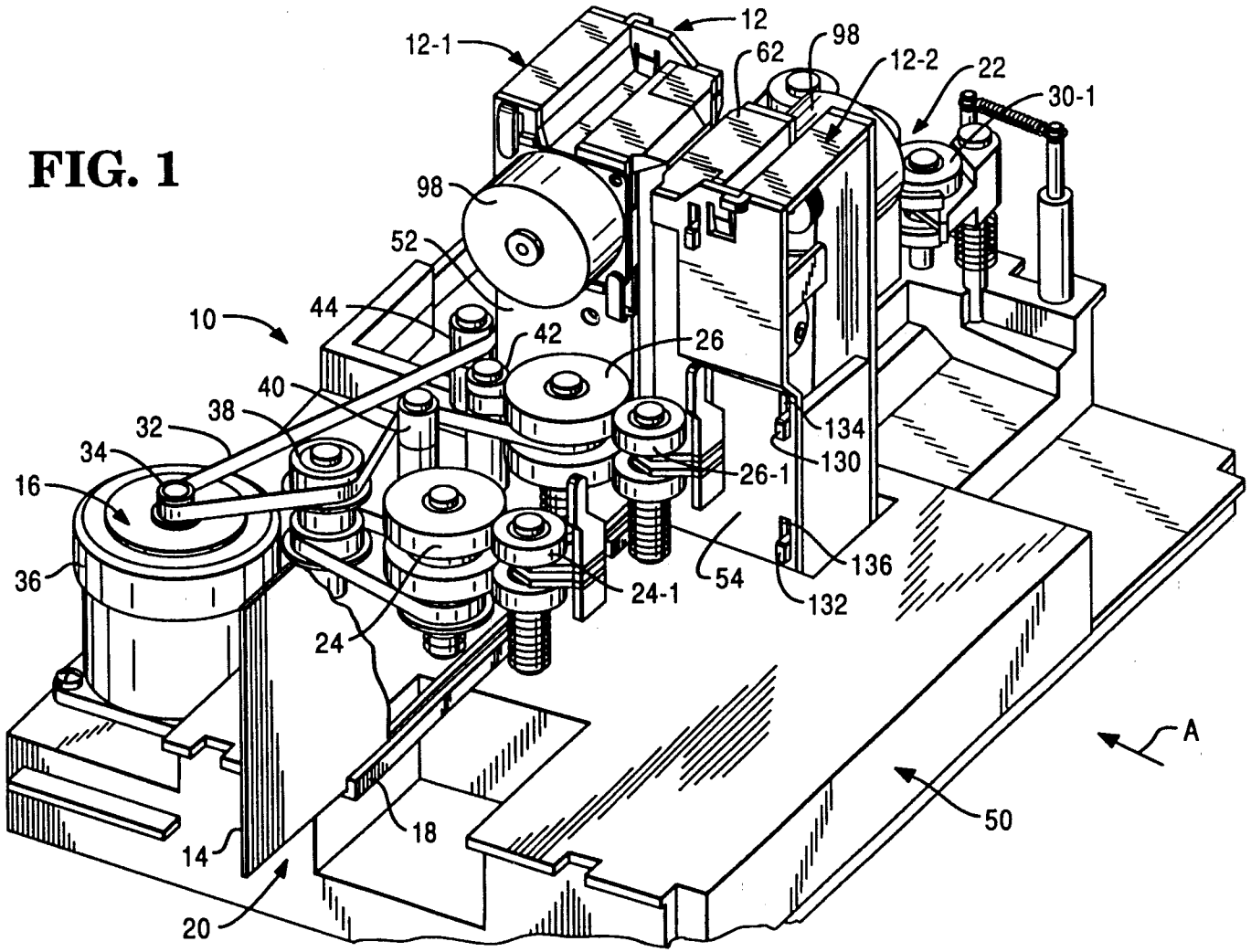
FIG. 1 is a general isometric view of a machine in which the apparatus of this invention may be incorporated, showing a transport means for moving a document in printing relationship with first and second printers for printing on the rear and front of the document.

FIG. 1 is a general isometric view of a machine 10 in which the apparatus 12 of this invention may be incorporated. The machine 10 may be a document processing machine like a bank teller's machine which is used for processing financial documents, like checks and deposit slips, for example. The apparatus 12 includes a first printer 12-1 and a second printer 12-2 depending upon customer requirements. In the embodiment described, the printers 12-1 and 12-2 are identical; therefore a discussion of only printer 12-1 will be given.

As an illustration, the printer 12-1 may be used for printing endorsements on the back of a document 14, shown entering the machine from the left side as viewed in FIG. 1, and the printer 12-2 may be used for printing data on the front of the document 14.

The machine 10 (FIG. 1) includes a transport means 16 for moving the document 14 in printing relationship with the printers 12-1 and 12-2. One of the features of the machine 10 is that the transport means 16 is bi-directional. In this regard, the document 14 is fed into a document track 18 from a first or entry side 20 and is moved in a first direction towards a second or output side 22, although the document 14 after being processed, may be exited from the entry side 20. Having a bi-directional transport means 16 enables the machine 10 to have a small footprint or enables it to be compact. The bi-directional transport means 16 also enables the apparatus 12 to be very versatile in what can be printed.

Figure 2:
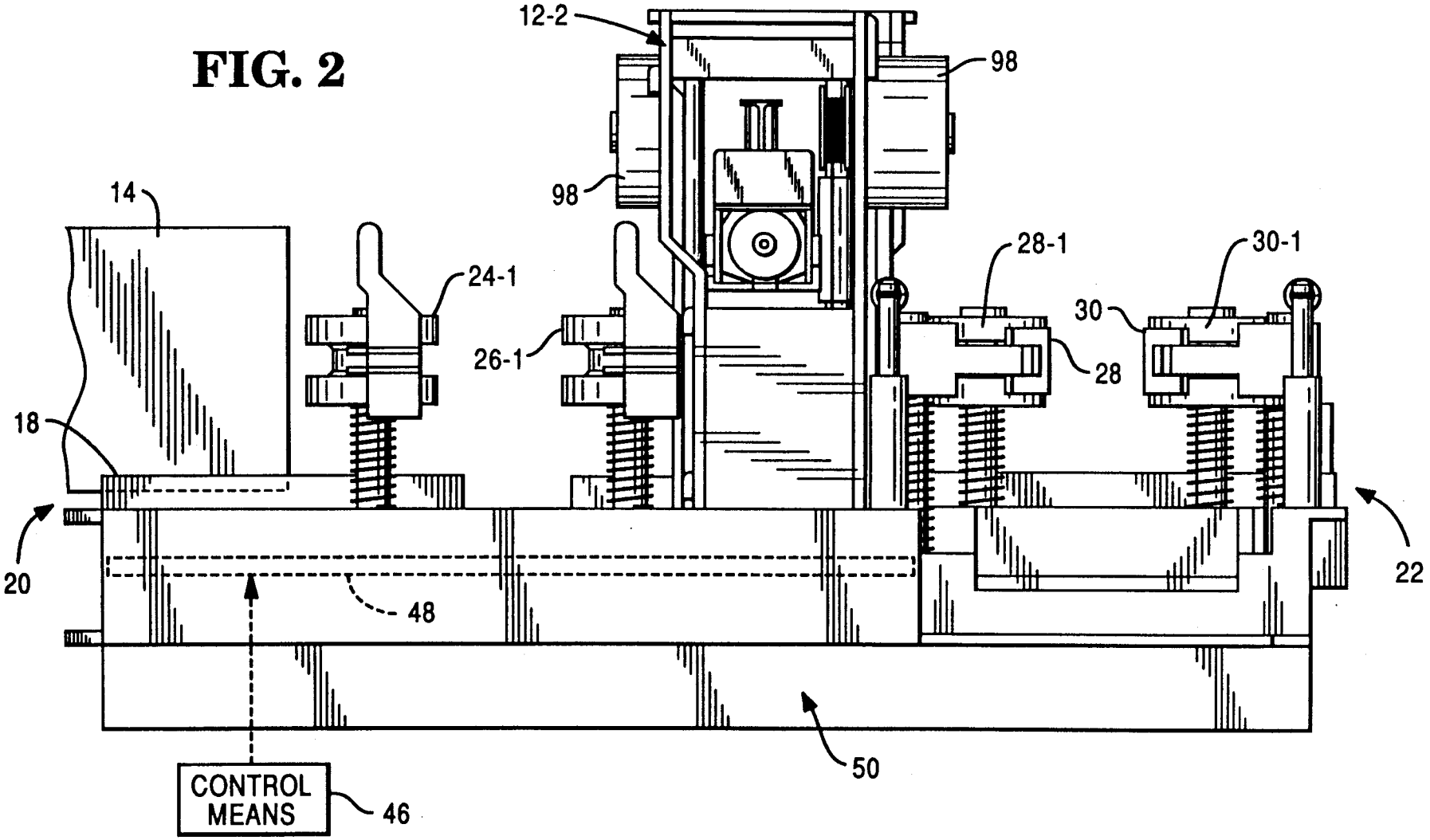
FIG. 2 is a front view, in elevation, of the machine shown in FIG. 1, and this view is taken form the direction of arrow A shown in FIG. 1.

The transport means 16 (FIGS. 1 and 2) includes a plurality of drive rollers 24, 26, 28, and 30 which are positioned along the document track 18 as shown, and each of these drive rollers has a pinch roller 24-1, 26-1, 28-1, and 30-1, respectively, associated therewith to move the document 14 positioned therebetween. The drive rollers 24, 26, 28, and 30 are coupled together to be rotated in the same direction by a timing belt 32 which is coupled to the output pulley 34 of a stepper motor 36. There are sufficient idler rollers like 38, 40, 42, and 44 to enable the timing belt 32 to be routed around the printers 12-1 and 12-2, for example, to enable the timing belt 32 to be coupled, also, to the drive rollers 28 and 30. The stepper motor 36 is bi-directional to enable the document 14 to be moved in both feeding directions mentioned. The transport means 16 can also be used as a staging apparatus to move and hold the document 14 at a particular location within the document track 18. A control means 46 (shown schematically in FIG. 2) for controlling the operation of the machine 10 is found on a printed circuit board 48 which is located within a chassis 50 of the machine 10.

Figure 3:
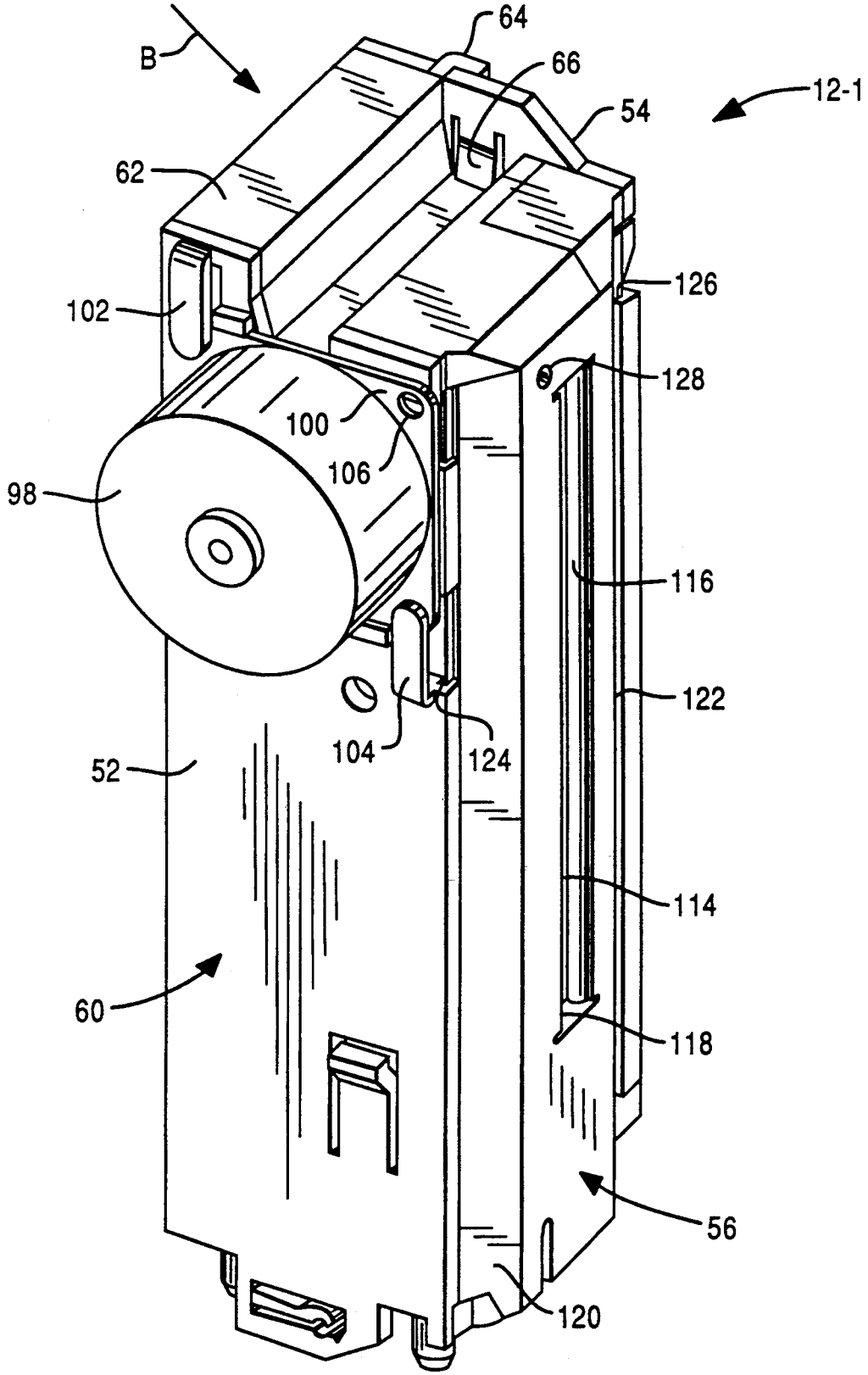
FIG. 3 is a general isometric view of the first printer, taken from a direction similar to that shown in FIG. 1.
Figure 4:
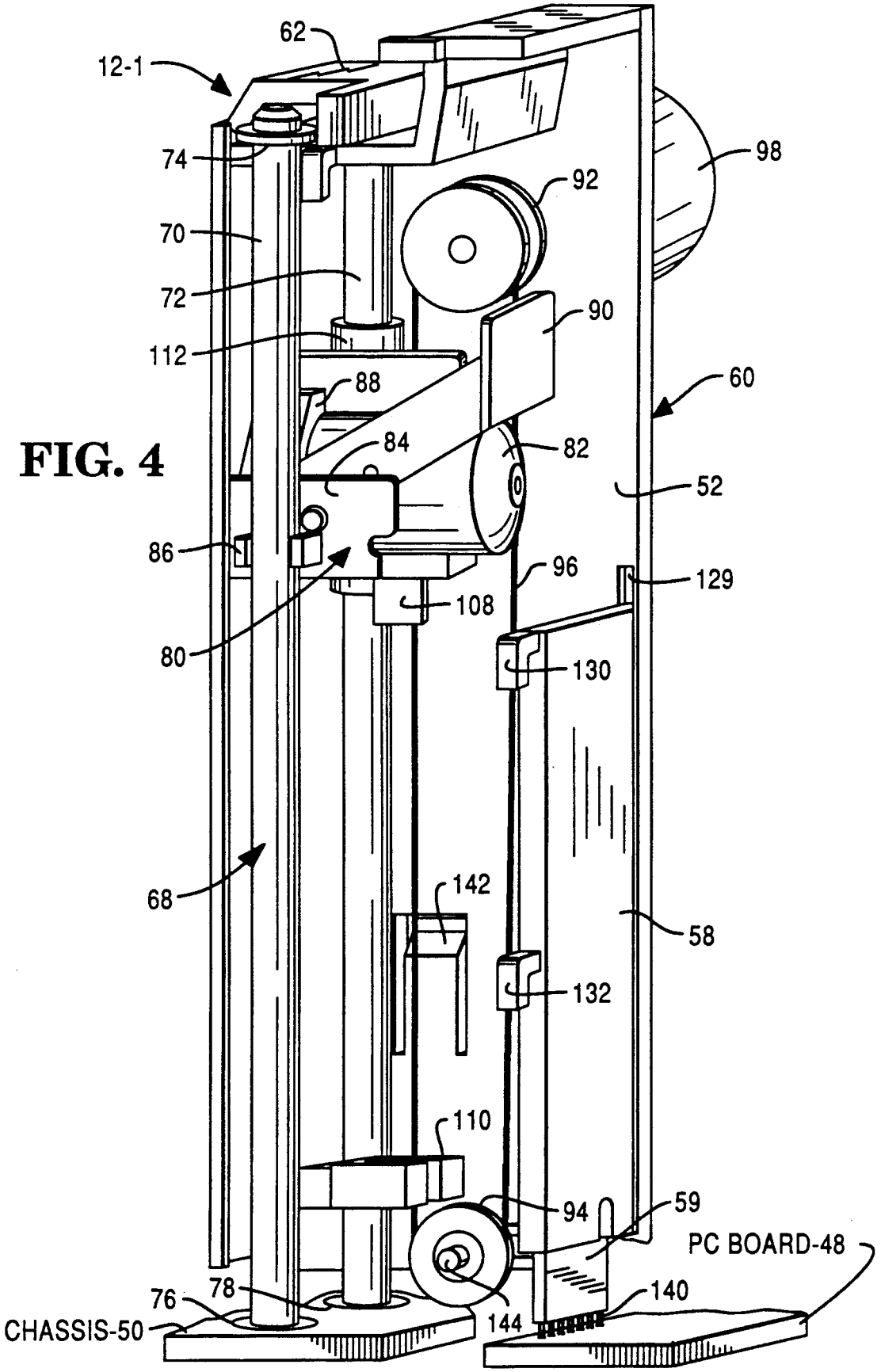
FIG. 4 is a general isometric view of the first printer shown in FIG. 3, and the view is taken along the line of arrow B shown in FIG. 3, with certain portions removed to show the interior of the printer.

The first or rear printer 12-1 is shown in more detail in FIGS. 3 and 4. The printer 12-1 includes first, second, third, and fourth walls 52, 54, 56, and 58 which make up a housing 60 which is generally quadrilateral in shape. In the embodiment described, the housing 60 is about two inches wide on a side and about six inches tall.

The first wall 52 and the second wall 54 are held in spaced parallel relationship at the top of the housing 60 by a spacer wall 62 (FIG. 3) which has tabs, like 64 and 66, to hold these three walls together. The printer 12-1 also has support means 68 (FIG. 4) coupled between the spacer wall 62 and the base or chassis 50 which is shown only schematically in FIG. 4. The support means 68 includes first and second rods 70 and 72 whose upper ends (as viewed in FIG. 4) are secured to the spacer wall 62 by suitable molded-in snaps 74. The lower ends of the rods 70 and 72 are positioned in locating bushings 76 and 78 (shown schematically in FIG. 4) when the printer 12-1 is mounted thereon. The bushings 76 and 78 are located in the chassis 50.

One function of the support means 68 is to locate the printer 12-1 relative to the document track 18, and another function is to support a carriage 80 on which a print head 82 is mounted. The carriage 80 has opposed side walls, like 84, which have resilient or expandable slide members, like 86, which partially embrace the associated rods 70 and 72 to enable the carriage 80 to be moved up and down as viewed in FIG. 4.

In the-embodiment described, the print head 82 is a THINKJET print head #51616A which is manufactured by Hewlett Packard. This print head 82 is a thermally driven ink jet printer which includes its own ink supply. When the supply of ink is exhausted, the print head 82 is simply thrown away and replaced with a new one. This reduces the possibility of service calls or maintenance in the field because an operator of the machine 10 can easily replace the print head 82 in the case of failure. The print head 82 is detachably held in place on the carriage 80 by a conventional latch 88 having an operating lever 90; when this lever is depressed, the print head 82 is released from the latch 88, permitting it to be removed from the printer 12-1.

A moving means for moving the carriage 80 bi-directionally in a vertical direction, as viewed in FIG. 4, includes a drive pulley 92, an idler pulley 94, a cable 96, and a stepper motor 98. The drive pulley 92 is coupled to the output shaft of the stepper motor 98, with this motor having a mounting flange 100 (FIG. 3) which is generally square in shape. The first wall 52 of the housing 60 has locking shoulders 102 and 104 thereon behind which the flange 100 is mounted. The mounting flange 100 also has apertures therein, like 106, which mate with raised circular areas or bosses on the locking shoulders 102 and 104 and first wall 52 when the mounting flange 100 is rotated to the position shown in FIG. 3 to lock the stepper motor 98 in place. A feature of this invention is that the parts making up the printer 12-1 are assembled without any fasteners. This makes the printer 12-1 inexpensive and reliable to manufacture and assemble. The stepper motor 98 is rotated bi-directionally under the control of the control means 46 to raise and lower the carriage 80 with the print head thereon.

The cable 96 (FIG. 4) alluded to earlier herein, has one end thereof secured to the drive pulley 92 by a special construction to be later described herein. There are extra turns of cable wound on the drive pulley 92 to have sufficient cable to enable the carriage 80 to be moved from the topmost position shown in FIG. 4 to its lowermost position. In the lowermost position, a lug 108 located on the underside of the carriage 80 cooperates with an associated sensor 110 to indicate to the control means 46 that the print head 82 is in a lowermost or home position. When the stepper motor 98 is energized to rotate in the opposite direction, the carriage 80 is moved upwardly until it contacts a limiting stop 112. In the embodiment described, the range of motion of the print head 82 is four inches, although the range may be altered to suit different applications. The printer 12-1 and chassis 50 are designed so that print head 82 can print on a document 14 from the bottom of the document track 18 to the top of the document 14 as viewed in FIG. 2.

As stated earlier herein, the housing 60 is generally comprised of first, second, third, and fourth walls 52, 54, 56, and 58 which make up a general quadrilaterally shaped housing. The walls 52 and 54 have already been discussed. One of the features of this invention is that the walls 56 and 58 perform functions in addition to that of simply being part of the housing 60. For example wall 56 (FIG. 3) forms a "shim" or document guide, while wall 58 supports a printed circuit board 59 (FIG. 4) which houses some of the processing circuitry associated with the first printer 12-1, for example.

The guide or wall 56 (FIG. 3) also performs the function of guiding documents, like 14, in printing relationship with the printers 12-1 and 12-2. In order to have precise printing, it is desirable to have the document to be printed upon remain at a predetermined distance from the print head 82. When both printers 12-1 and 12-2 are placed along the document track 14, the associated guides or walls 56 face each other and provide sufficient clearance for the width of the document 14 to pass therebetween. In the embodiment described, the guide or wall 56 is made of blue tempered #1095 steel which is 0.005 of an inch thick; this provides sufficient resilience or robustness to prevent damage thereto by an operator of the machine 10. The guide or wall 56 has a slot 114 therein which extends vertically as viewed in FIG. 3. This slot is over four inches long in the embodiment described to enable the print head 82 to print on a document 14 which is up to four inches high. Because the document 14 may be fed bi-directionally within the document track 18, the guide or wall 56 is provided with ramps 116 and 118 which are located on the sides of the slot 114 so as to prevent the leading edge of the document 14 from being caught by the slot 114. The guide or wall 56 also is shaped to provide chamfered edges 120 and 122 which project slightly into the document track 18 when the printers 12-1 and 12-2 are positioned at the document track 18 as will be described hereinafter.

The guide or wall 56 (FIG. 3) is held in place in the housing 60 in the following manner. The first and second walls 52 and 54 have slotted edges or recesses 124 and 126, respectively, formed therein to slidably receive flanges on the guide or wall 56. The guide or wall 56 is inserted in the housing 60 by pushing the guide or wall 56 downwardly, as viewed in FIG. 3, until a raised projection or boss 128 on the spacer wall 62 engages an aligned hole in the guide or wall 56 to retain it in place.

Another feature of this invention is that the fourth wall 58 (FIG. 4) also functions as a support for the circuit board 59 which handles the driver electronics associated with the print head 82. The wall 52 has a slot in the area 129 (FIG. 4) to slidably receive one side of the wall 58, and the wall 58 has hook-type extensions 130 and 132 on the opposed side thereof to be inserted through slots 134 and 136 (FIG. 1). After insertion through the slots 134 and 136, the wall 58 is pushed downwardly, as viewed in FIG. 1, to secure the wall 58 to the housing. The circuit board 59 has plug-in contacts 140 to couple the circuit board 59 on the wall 58 to the P.C. board 48. There is some looseness in the mounting between the circuit board 59 and the wall 58 to allow for some minor movement between the circuit board 59 and the P.C. board 48 (due to a misalignment therebetween) to enable the circuit board 59 to be plugged into the P.C. board 48. The connection cables associated with the stepper motor 96 and the print head 82 are coupled to the circuit board 59 on the wall 58.

When the housing 60 (FIG. 4) is assembled as described, the rods 70 and 72 extending from the housing are inserted in the bushings 76 and 78 to align the housing 60 and the print head 82 therein relative to the document track 18. As the housing 60 is pushed downwardly as viewed in FIG. 4, a hold-down snap member 142 engages a portion of the chassis 50 to detachably retain the housing 60 thereon. At the same time, the plug-in contacts 140 associated with the printed circuit board 59 on wall 58 are coupled to the P.C. board 48 which is part of the control means 46. The printers 12-1 and 12-2 may be controlled by the control means 46 in a conventional manner.

Figure 5:
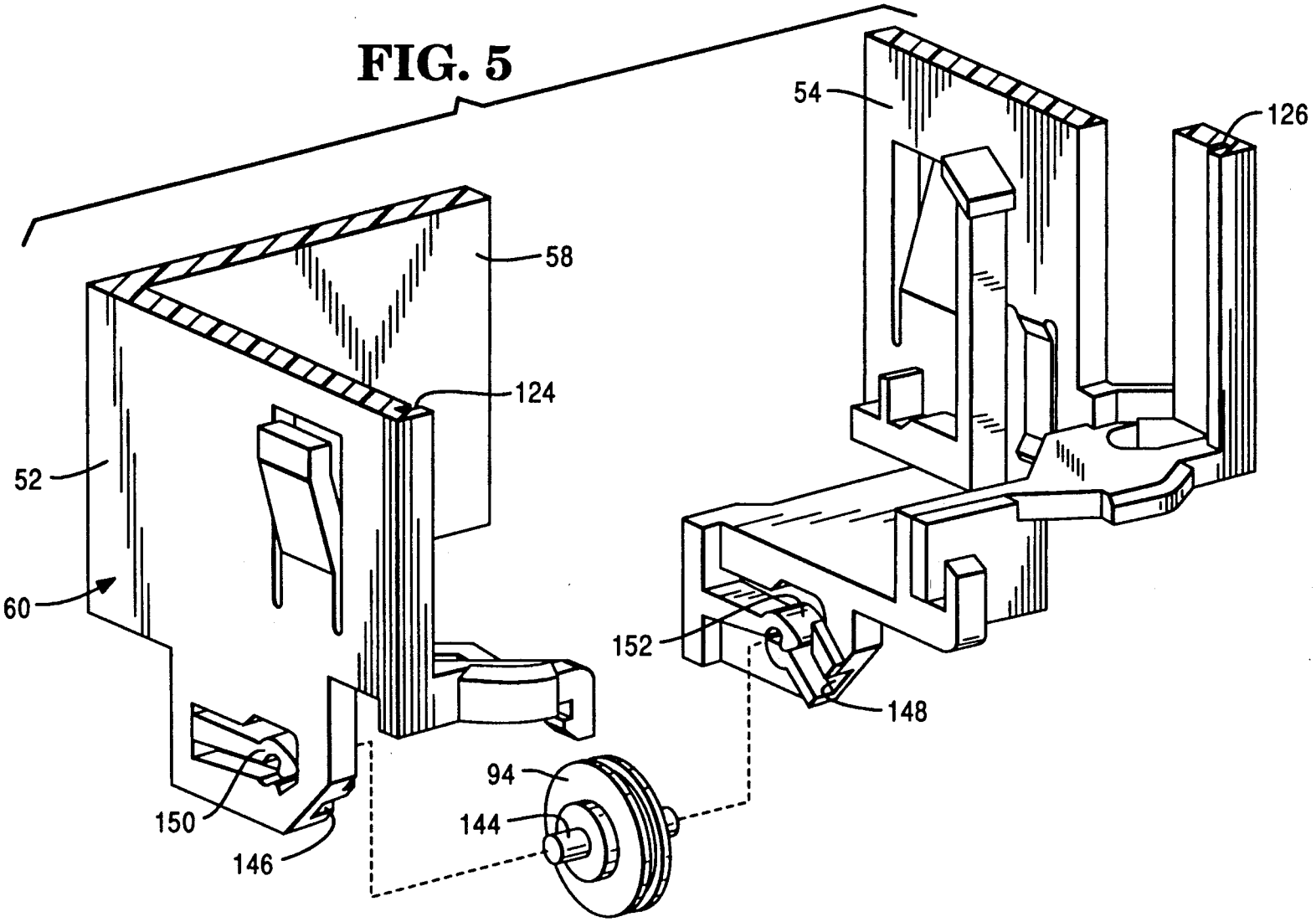
FIG. 5 is a general exploded view of a portion of the housing shown in FIG. 3.

As alluded to earlier herein, the pulley 94 (FIG. 4) is mounted in the housing 60 to place some tension on the cable 96 in the following manner. The idler pulley 94 has a shaft 144 extending therefrom as shown in FIG. 5. The housing 60 has recesses 146 and 148 therein to receive the ends of the shaft 144 to rotatably support it. Two cantilever type members 150 and 152 which are molded in the housing 60 are used to maintain a downward bias (as viewed in FIG. 5) on the idler pulley 94 to tension the cable 96.

Figure 6:
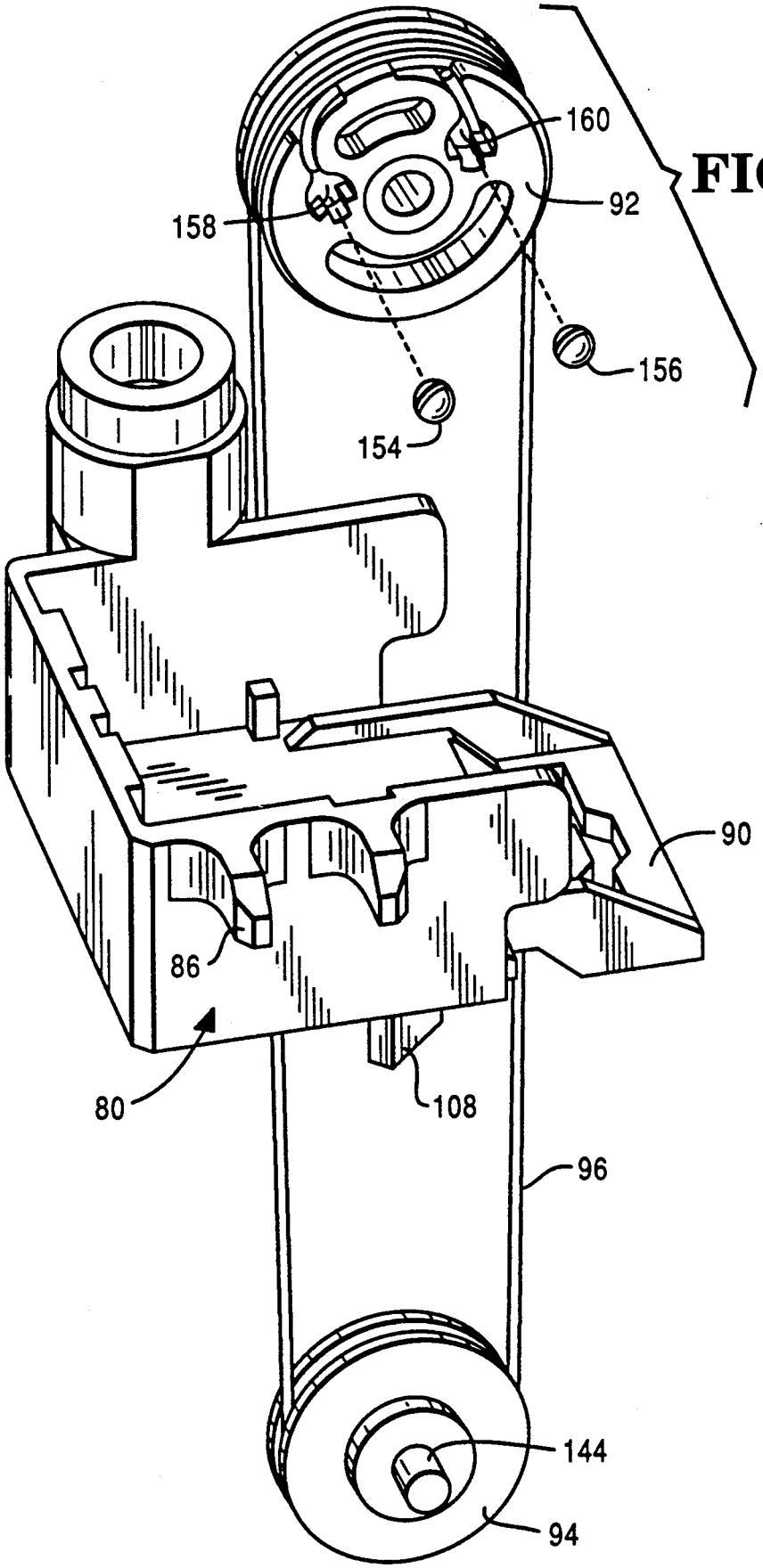
FIG. 6 is a isometric view of a printer carriage shown in FIG. 4.

The ends of the cable 96 are secured to the drive pulley 92 as shown in FIG. 6. A split metal ball 154, for example, having one end of the cable 96 crimped between the split portions is pushed into the hole 158, and similarly, a split metal ball 156 having the remaining end of the cable 96 crimped between the split portions is pushed into the hole 160. The cable 96 is secured to the carriage 80 by a ball and hole construction similar to ball 154 and hole 158, for example. This construction provides an easy to assemble means for securing the cable 96 to the drive pulley 92.

What is claimed is:

1. An apparatus comprising:

a base having a document track therein, with said document track having a bottom surface therein for guiding a document thereon;

a housing having first, second, third, and fourth walls forming a general quadrilateral tubular shape, and a spacer wall for maintaining said first and second walls in spaced parallel relationship;

support means coupled between said spacer wall and said base for supporting a carriage;

a carriage slidably mounted on said support means;

moving means for moving said carriage bi-directionally on said support means along a first line;

said third side wall being a flexible guide having an elongated slot therein;

securing means for securing said flexible guide to said first and second walls;

a print head;

mounting means for mounting said print head on said carriage to print through said elongated slot along the height of a document in said document track and transport means for bi-directionally moving said document along a second line perpendicular to said first line past said flexible guide in printing relationship with said print head.

2. The apparatus as claimed in claim 1 in which said print head is a replaceable, thermally driven ink jet print head.

3. The apparatus as claimed in claim 1 in which said housing has a length and in which said general quadrilateral shape is small in cross section relative to said length of said housing.

4. The apparatus as claimed in claim 1 in which said moving means comprises:

a stepper motor mounted on said first wall, with said stepper motor having an output shaft and a pulley mounted on said output shaft; and a cable operatively connected to said pulley and said carriage to move said carriage bi-directionally along said line as said stepper motor is rotated in first and second directions.

5. The apparatus as claimed in claim 4 in which said first and second walls have formed therein a tensioning means for maintaining tension on said cable.

6. The apparatus as claimed in claim 1 in which said support means includes first and second rods, with each said first and second rod having an upper end and a lower end; said upper ends being mounted in said spacer wall and said lower ends being mounted in said base.

7. The apparatus as claimed in claim 1 in which said housing is positioned on said base to enable said carriage with the print head thereon to be moved between upper and lower positions in said housing to enable said print head to print on said document near said bottom surface of said document track.

8. A compact housing for a printer comprising:

first, second, third, and fourth walls forming a general quadrilateral tubular shape, and a spacer wall for maintaining said first and second walls in spaced parallel relationship;

mounting means for mounting a print head in said housing;

securing means for detachably securing said housing adjacent to a document track;

said third wall having a ramp surface for guiding a document in said document track in operative relationship with said print head; and said fourth wall having a circuit board mounted thereon with said circuit board having contacts thereon for engagement with a control means when said housing is secured adjacent to said document track.

9. The housing as claimed in claim 8 in which said third wall is made of thin steel.

10. The housing as claimed in claim 9 in which said securing means include first and second rods, with said first and second rods being part of said mounting means.

11. A printer comprising:

a housing having first, second, third, and fourth walls forming a general quadrilateral tubular shape, and a spacer wall for maintaining said first and second walls in spaced parallel relationship;

support means coupled between said spacer wall and said base for supporting a carriage;

a carriage slidably mounted on said support means;

moving means for moving said carriage bi-directionally on said support means along a first line;

said third side wall being a flexible guide having an elongated slot therein;

securing means for securing said flexible guide to said first and second walls;

a print head;

mounting means for mounting said print head on said carriage to print through said elongated slot along the height of a document in a document track; and attachment means on said housing for detachably securing said printer adjacent to said document track.

12. The printer as claimed in claim 11 in which said fourth wall has a printed circuit board mounted thereon, with said printed circuit board having a circuit for controlling said printer, said printed circuit board also having contacts thereon for coupling to a control means when said printer is mounted adjacent to said document track.

13. An apparatus comprising:

a base having a document track therein, with said document track having a bottom surface therein for guiding a document thereon; and first and second printers mounted on opposed sides of said document track;

said first and second printers each comprising:

a housing having first, second, third, and fourth walls forming a general quadrilateral tubular shape, and a spacer wall for maintaining said first and second walls in spaced parallel relationship;

support means coupled between said spacer wall and said base for supporting a carriage;

a carriage slidably mounted on said support means;

moving means for moving said carriage bi-directionally on said support means along a first line;

said third side wall being a flexible guide having an elongated slot therein;

securing means for securing said flexible guide to said first and second walls;

a print head; and mounting means for mounting said print head on said carriage to print through said elongated slot along the height of the document in said document track;

said first and second printers also having, respectively, first and second attachment means for detachably securing the associated said first and second printers to said base on said opposed sides of said document track;

said apparatus further comprising:

transport means for bi-directionally moving said document along a second line perpendicular to said first line associated with said first and second printers and also for moving said document past said flexible guides associated with said first and second printers in printing relationship therewith.

14. The apparatus as claimed in claim 13 said print head in each of said first and second printers is a replaceable, thermally driven ink jet print head.

* * * * *